US009672721B2

(12) United States Patent
Jeong

(10) Patent No.: US 9,672,721 B2
(45) Date of Patent: Jun. 6, 2017

(54) METHOD AND APPARATUS FOR CONTROLLING COOKING DEVICE

(71) Applicant: Dongbu Daewoo Electronics Corporation, Seoul (KR)

(72) Inventor: Seong Yeop Jeong, Seoul (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 32 days.

(21) Appl. No.: 14/170,464

(22) Filed: Jan. 31, 2014

(65) Prior Publication Data

US 2015/0179042 A1 Jun. 25, 2015

(30) Foreign Application Priority Data

Dec. 19, 2013 (KR) ..... 10-2013-0159459

(51) Int. Cl.

| | |
|---|---|
| ***G08B 21/18*** | (2006.01) |
| ***G08B 3/10*** | (2006.01) |
| ***G08B 5/38*** | (2006.01) |
| ***F24C 3/12*** | (2006.01) |
| ***F24C 5/16*** | (2006.01) |
| ***F24C 7/08*** | (2006.01) |
| *F24C 15/02* | (2006.01) |
| *F24C 15/04* | (2006.01) |

(52) U.S. Cl.

CPC ..... *G08B 21/182* (2013.01); *F24C 3/12* (2013.01); *F24C 5/16* (2013.01); *F24C 7/08* (2013.01); *F24C 15/02* (2013.01); *G08B 3/10* (2013.01); *G08B 5/38* (2013.01); *F24C 15/028* (2013.01); *F24C 15/04* (2013.01)

(58) Field of Classification Search

CPC ..... F24C 7/02; F24C 15/04; F24C 15/028
USPC .... 340/584, 635, 636.18, 679; 219/720, 506
See application file for complete search history.

(56) References Cited

U.S. PATENT DOCUMENTS

| | | | | |
|---|---|---|---|---|
| 4,393,300 | A * | 7/1983 | Proctor | 219/497 |
| 5,968,402 | A * | 10/1999 | Lee | 219/720 |
| 2005/0016991 | A1* | 1/2005 | Wilsdorf | 219/506 |
| 2005/0105009 | A1* | 5/2005 | Dunn et al. | 349/21 |
| 2009/0010305 | A1* | 1/2009 | Meijer | G01K 11/12 374/161 |
| 2011/0140899 | A1* | 6/2011 | Flandin | G01J 5/0066 340/584 |
| 2013/0234847 | A1* | 9/2013 | Carson et al. | 340/449 |

(Continued)

FOREIGN PATENT DOCUMENTS

| | | | |
|---|---|---|---|
| DE | 19836732 | A1 | 2/2000 |
| EP | 2189727 | A1 | 5/2010 |
| JP | 2013-238358 | A | 11/2013 |

(Continued)

OTHER PUBLICATIONS

Korean Patent Abstracts, Publication No. 10-2011-0097141, Published Aug. 31, 2011, KIPO, Republic of Korea.

*Primary Examiner* — Hongmin Fan

(57) ABSTRACT

A method for controlling a cooking device includes detecting a temperature of a door on the cooking device, comparing the detected temperature with a predetermined warning and/or reference temperature, generating a predetermined warning if the detected temperature is equal to or higher than the predetermined warning and/or reference temperature, and outputting the predetermined warning.

6 Claims, 6 Drawing Sheets

(56) References Cited

U.S. PATENT DOCUMENTS

| | | | | |
|---|---|---|---|---|
| 2014/0120219 | A1* | 5/2014 | Ewell, Jr. ..... | A47J 27/62<br>426/231 |

FOREIGN PATENT DOCUMENTS

| | | | |
|---|---|---|---|
| JP | 2013238358 | * | 11/2013 |
| KR | 20060118660 | A | 11/2006 |
| KR | 10-2009-0115408 | A | 11/2009 |
| KR | 20090115408 | A | 11/2009 |
| KR | 10-2011-0097141 | | 8/2011 |

* cited by examiner

METHOD AND APPARATUS FOR CONTROLLING COOKING DEVICE

CROSS-REFERENCE TO RELATED APPLICATION(S)

This application claims priority to Korean Patent Application No. 10-2013-0159459, filed on Dec. 19, 2013, which is incorporated herein in its entirety by reference.

TECHNICAL FIELD

The present disclosure relates to a method and apparatus for controlling a cooking device, and more particularly, to a method and apparatus for controlling a cooking device, e.g., an oven, which is configured to display the state of the temperature of its door and to provide a burn danger warning when its door temperature is higher than a reference temperature during its cooking operation.

BACKGROUND

As is well known in the art, an oven, a microwave oven, or a combined hood and microwave oven are cooking devices for heating food using, respectively, microwaves or heat that is generated from a heater.

Such cooking devices generate heat of high temperature when they operate in cooking mode. In a conventional convection oven, the heat may lead to a rise in the temperature of a door or door handle that is attached to the front part of the oven, thereby causing, for example, a burn of its user. Although the door or door handle of microwave ovens seldom becomes hot, the tray(s) and/or rod(s) that are sometimes present therein can become hot and cause burns.

Accordingly, there is a need for a method for alerting a user to the danger of burns in order to protect the user from burns. One conventional method for protecting a user from burns is to embed an insulating material in the door or door handle, or adopt a door cooling device.

Although conventional cooking devices using such insulating material or door cooling device may protect a user from burns, they may have a complicated door structure and/or high manufacturing cost.

SUMMARY

The present disclosure describes a method and apparatus for controlling a cooking device, which are capable of detecting the temperature of a door on the cooking device and giving a warning when the detected temperature is equal to or higher than a predefined warning and/or reference temperature.

Furthermore, the present disclosure describes a method and apparatus for controlling a cooking device that are capable of displaying various temperature indications and/or colors corresponding to the level of the detected temperature of or at the door on the cooking device.

In accordance with one or more embodiments of the present disclosure, there is provided a method for controlling a cooking device, including detecting a temperature of a door on the cooking device, comparing the detected temperature with a predetermined warning and/or reference temperature, instructing the cooking device to generate a predetermined warning if the detected temperature is equal to or higher than the predetermined warning and/or reference temperature, and outputting the predetermined warning.

In one or more embodiments, outputting the predetermined warning may include flickering one or more warning labels corresponding to the predetermined warning on a display panel on the cooking device.

In one or more embodiments, the color of the warning label may change depending on the level of the detected temperature.

In one or more embodiments, outputting the predetermined warning may include flickering an indication lamp on or in the cooking device.

In one or more embodiments, outputting the predetermined warning may include generating an intermittent or constant buzzer sound with a buzzer on or in the cooking device.

In one or more embodiments, an interval and/or volume of the buzzer sound may change depending on the level of the detected temperature.

In accordance with one or more other embodiments of the present disclosure, there is provided an apparatus for controlling a cooking device, including a temperature sensor configured to detect a temperature of a door on the cooking device, a warning control unit configured to compare the detected temperature with a predetermined warning and/or reference temperature and generate a predetermined warning if the detected temperature is equal to or higher than the predetermined warning and/or reference temperature, and a warning display unit configured to output the predetermined warning.

In one or more embodiments, the temperature sensor is on an inner surface of a door. When the door has a dual glass or double-pane structure, the sensor may be on an inner surface of the outside pane.

In one or more embodiments, the warning display unit may include a display panel for flickering one or more predetermined warning labels corresponding to the predetermined warning.

In one or more embodiments, the warning display unit may change an indication color of the warning label, depending on the detected temperature (or level thereof).

In one or more embodiments, the display panel may include a part of or the entirety of a front surface of the door.

In one or more embodiments, the warning display unit may include an indication lamp flickering in response to an instruction received from the warning control unit.

In one or more embodiments, the warning display unit may include a buzzer configured to output an intermittent or constant buzzer sound corresponding to the predetermined warning.

In one or more embodiments, the warning display unit may change the interval and/or volume of the buzzer and/or sound depending on a level of the detected temperature.

In accordance with one or more other embodiments of the present disclosure, there is provided a method for controlling a cooking device, including detecting a temperature of a door on the cooking device, determining a level of the detected temperature, and displaying a temperature indication color corresponding to the determined level of the detected temperature. The method may further include providing an instruction to display the temperature indication color.

In one or more embodiments, the temperature indication color may comprise different colors for room temperature, a pre-heat temperature, and a burn danger and/or warning temperature.

In one or more embodiments, displaying the temperature indication color may include flickering the temperature indication color on a display panel on the cooking device.

In accordance with one or more other embodiments of the present disclosure, there is provided an apparatus for controlling a cooking device, including a temperature sensor configured to detect a temperature of a door on the cooking device, a temperature color determination unit configured to determine a level of the detected temperature and a temperature indication color corresponding to the level of the detected temperature, and a color display unit configured to display the determined temperature indication color.

In one or more embodiments, the color display unit may include a display panel on a part or the entirety of a front surface of the door. In one or more alternate embodiments, the color display unit may include a display panel on a front panel of the oven.

In one or more embodiments, the color display unit may flicker the determined temperature indication color on the display panel.

One or more embodiments of the present disclosure can effectively protect a user from burns that may be caused by a high temperature of the door, by detecting a temperature of the door on the cooking device and outputting a warning when the detected temperature is equal to or higher than a preset warning and/or reference temperature.

Furthermore, one or more embodiments of the present disclosure can allow a user to visually and clearly recognize a door temperature state of a cooking device in operation by displaying various temperature indication colors corresponding to temperature value levels detected from the door on the cooking device.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
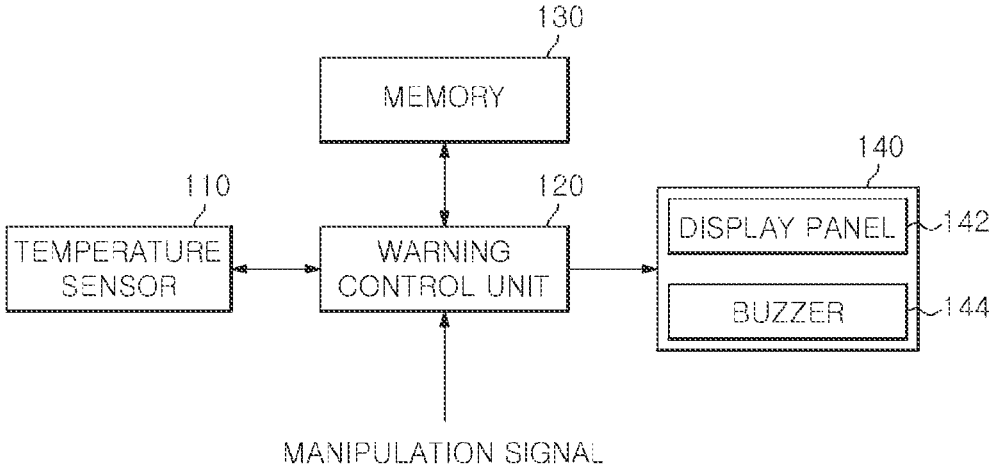
FIG. 1 is a block diagram of an apparatus for controlling a cooking device according to one or more embodiments of the present disclosure.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

One or more exemplary embodiments of the present disclosure will be described more fully hereinafter with reference to the accompanying drawings, in which one or more exemplary embodiments of the disclosure can be easily determined by those skilled in the art. As those skilled in the art will realize, the described exemplary embodiments may be modified in various different ways, all without departing from the spirit or scope of the present disclosure, which is not limited to the exemplary embodiments described herein.

It is noted that the drawings are schematic and are not necessarily dimensionally illustrated. Relative sizes and proportions of parts in the drawings may be exaggerated or reduced in their sizes, and a predetermined size is just exemplary and not limiting. The same reference numerals designate the same structures, elements, or parts illustrated in two or more drawings in order to exhibit similar characteristics.

Exemplary embodiments of the present disclosure illustrate ideal exemplary embodiments of the present disclosure in more detail. As a result, various modifications of the drawings are expected. Accordingly, the exemplary embodiments are not limited to a specific form or illustrated region, and, for example, include modifications of form (e.g., by manufacturing).

FIG. 1 is a block diagram of an apparatus for controlling a cooking device according to one or more embodiments of the present disclosure. The apparatus for controlling a cooking device may include a temperature sensor 110, a warning control unit 120, memory 130, and a warning display unit 140. The warning display unit 140 may include a display panel 142 and a buzzer 144.

Referring to FIG. 1, the temperature sensor 110 may detect the temperature of a door (e.g., doors 502 and 602 in FIGS. 5 and 6, respectively), or door handle (e.g., handles 504 and 604 in FIGS. 5 and 6, respectively), on a cooking device (e.g., ovens 500 and 600 in FIGS. 5 and 6, respectively), such as an oven, a microwave oven, or a combined hood and microwave oven, periodically (e.g., in a cycle of several seconds) when the cooking device cooks food in a cooking mode in response to a user's manipulation, and may transfer the detected temperature to the warning control unit 120.

Figure 5:
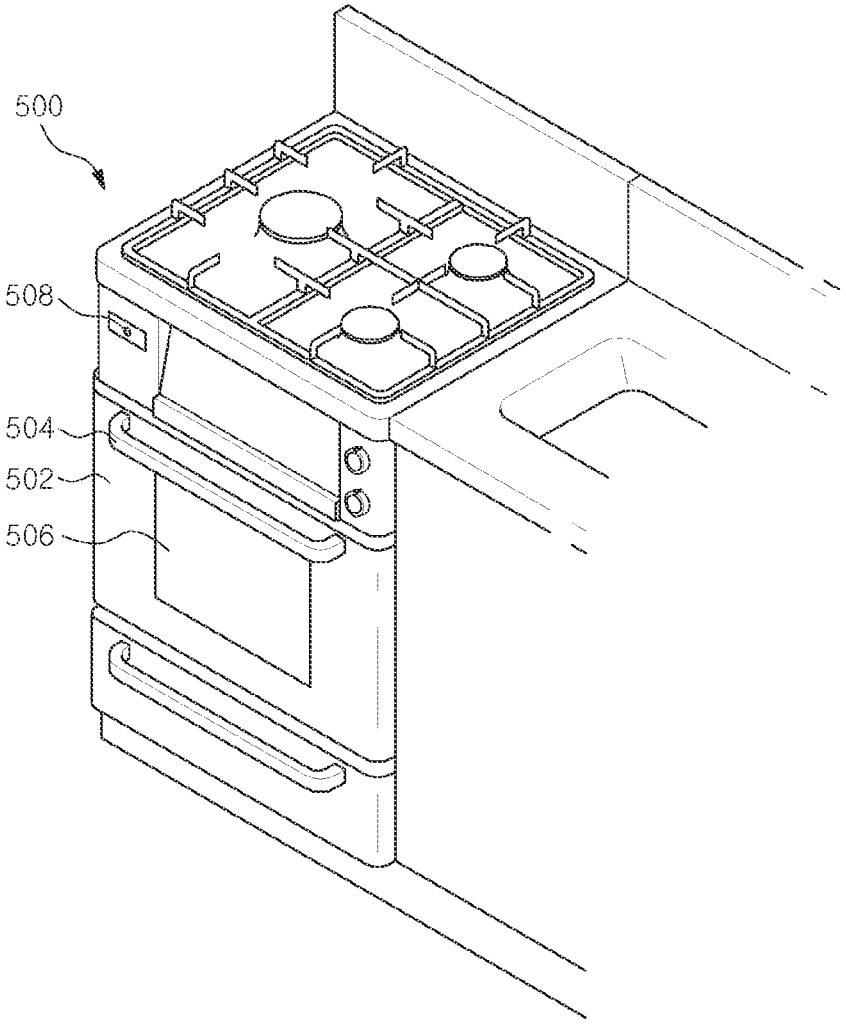
FIG. 5 is a perspective view showing exemplary embodiments of a cooking device on which an apparatus for controlling the cooking device according to one or more embodiments of the present disclosure can be mounted.
Figure 6:
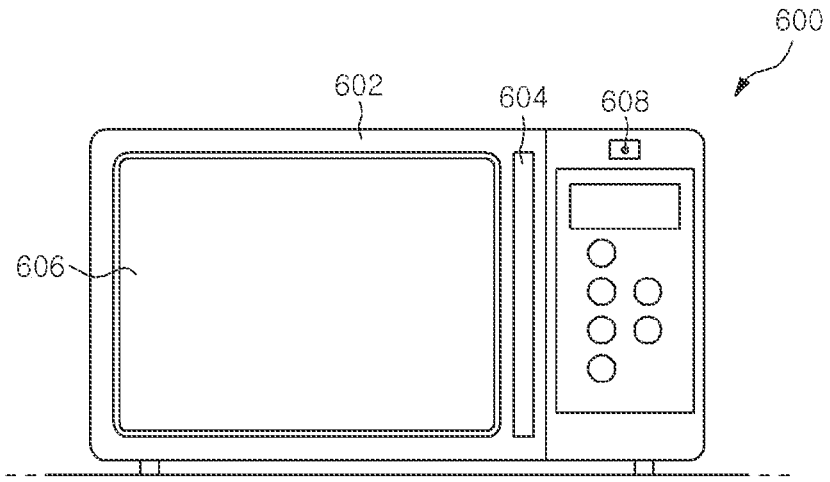
FIG. 6 is a perspective view showing other exemplary embodiments of a cooking device on which an apparatus for controlling a cooking device according to one or more embodiments of the present disclosure can be mounted.

Referring to FIG. 5, the temperature sensor 110 may be attached to the inside of the door 502 that is on the cooking device 500 having the structure as shown, or referring to FIG. 6, to the inside of the door 602 that is on the cooking device 600 having the structure as shown in FIG. 6. Moreover, the temperature sensor 110 may be at a position close to the door handle 504 or 604 on an inside of the door 502 or 602. In one embodiment, the oven has, for example, a dual glass or double pane structure.

Referring again to FIG. 1, the warning control unit 120 may include a microprocessor for generally controlling (or executing) a cooking operation in the cooking device in response to a user manipulation signal received through an input interface (not shown) (e.g., a touch panel, a manipulation panel, or a manipulation switch). The warning control unit 120 may compare a detected temperature with a predetermined warning and/or reference temperature (e.g., temperature at which a user may suffer a burn when the user touches the door or door handle) stored in the memory 130 when the value of the detected temperature is received from the temperature sensor 110 while the cooking device executes a cooking mode. Further, the warning control unit 120 may then generate a control instruction (i.e., an instruction for generating a selective warning) for generating a predefined warning (e.g., a visual warning or an audio warning) if, based on the comparison, the detected temperature is found to be higher than the predetermined warning and/or reference temperature, and transfer the control instruction to the warning display unit 140.

To this end, the memory 130 stores the information about the predetermined warning and/or reference temperature. The warning and/or reference temperature may be changed by a user's manipulation, if necessary.

Furthermore, the display panel 142 of the warning display unit 140 may present a user with a visual warning of the danger of burn from the door (or door handle) by outputting (or displaying) predetermined warning labels (e.g., "Caution burn at door handle") provided by the warning control unit 120 along with a control instruction for generating a visual warning in such a manner that the predetermined warning labels blink on and off. The color of the predetermined warning labels outputted (or displayed) through the display panel 142 may vary depending on the level of the detected temperature. For example, in one embodiment, the color may change in the order of yellow, orange, and red, from the time at which the detected temperature rises above a certain reference temperature.

The display panel 142 that is contained in the warning display unit 140 as visual warning device or interface as described above may be disposed (or mounted) to include a part of or the entirety of the glass surface 506 or 606 of the door 502 or 602 when the cooking device has the structure as illustrated in, for example, FIGS. 5 and 6.

Furthermore, the buzzer 144 of the warning display unit 140 may provide a user with an audio warning of the danger of burn from the door (or door handle) by generating an intermittent buzzer and/or sound when a control instruction for generating an audio warning is received from the warning control unit 120. The buzzer sound may vary in such a manner that the interval of the buzzer sound becomes shorter and/or louder as the detected temperature (i.e., the level of the detected temperature) becomes higher than a certain temperature and that the interval of the buzzer sound becomes longer and/or softer as the detected temperature (i.e., the level of the detected temperature) becomes lower than such certain temperature. In one or more alternate embodiments, a voice warning may be provided.

The buzzer 144 included in the warning display unit 140 as an audio warning as described above, may be or comprise a buzzer 508, or 608, at a specific position at the front of the cooking device 500, or 600, if the cooking device has the structure as shown in, for example, FIGS. 5 and 6.

Referring to FIGS. 5 and 6, according to one or more exemplary embodiments of the present disclosure, the display panel may be configured (or installed) to include a part of or the entirety of the glass surface 506 or 606 of the door 502 or 602 on the cooking device 500 or 600. However, it does not limit the position of the display panel. For example, the display panel may be installed at any position at the front of the cooking device if the display panel does not hinder the presentation of the visual warning to a user.

Meanwhile, in one or more exemplary embodiments of the present disclosure, the display panel may be used to display a visual burn danger warning, but is not necessarily limited thereto. For example, a visual burn danger warning may be generated in which an indication lamp (e.g., an LED), is installed at a specific position on the front of the door and the lamp blinks on and off.

A series of processes for providing a user with a warning concerning the danger of burn from the door of the apparatus for controlling a cooking device according to one or more exemplary embodiments of the present disclosure are described below in detail.

Figure 2:
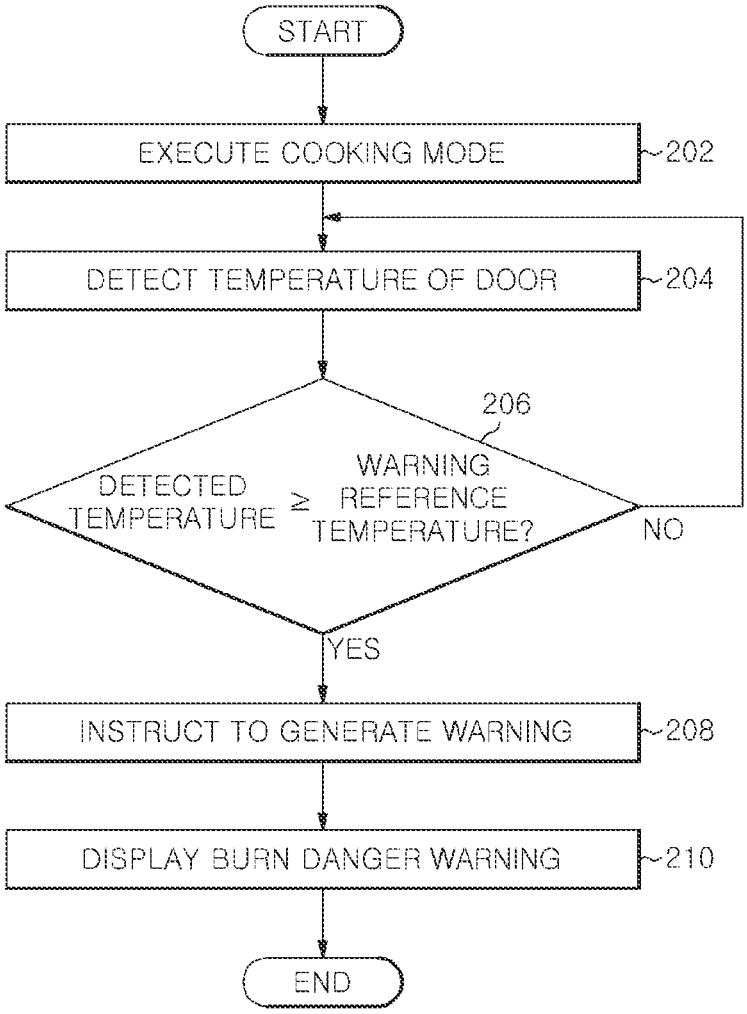
FIG. 2 is a flowchart illustrating steps in an exemplary method for warning a user of the danger of burns from a door having a high temperature according to one or more embodiments of the present disclosure.

FIG. 2 is a flowchart of a process of warning a user of the danger of burn from a door according to one embodiment of the present disclosure.

Referring to FIG. 2, when a cooking device executes a cooking mode according to a user's manipulation at 202, the temperature sensor 110 (in FIG. 1) periodically samples and/or detects a temperature of the door (or door handle) in a predetermined cycle and provides the warning control unit 120 with the detected temperature at 204.

The warning control unit 120 determines whether or not the detected temperature received from the temperature sensor 110 is equal to or higher than the predetermined warning and/or reference temperature by comparing the detected temperature with the predetermined warning and/or reference temperature (e.g., temperature at which a user may suffer a burn when his skin touches the door (or door handle)) stored in the memory 130 at 206.

If, as a result of the determination at 206, the detected temperature is found to be equal to or higher than the predetermined warning and/or reference temperature, the warning control unit 120 generates a control instruction for generating a predetermined visual (e.g., color, written characters, graphics, etc.) or audio (e.g., a buzzer, a beep, a voice, etc.) warning (i.e., a burn danger warning) and provides the warning display unit 140 with the control instruction at 208.

In response thereto, the display panel 142 of the warning display unit 140 presents a user with a visual burn danger warning at the door (or door handle) by outputting (or displaying) predetermined warning labels (e.g., "Caution burn at door handle") which are received from the warning control unit 120 along with the control instruction for generating a visual warning in such a manner that the predetermined warning labels blink on and off. Further, the buzzer 144 presents the user with an audio burn danger warning at the door (or door handle) by generating an intermittent buzzer sound in response to the control instruction received from the warning control unit 120 at 210. In one or more embodiments, a color warning may be provided during use and/or prior to oven operation. In one or more embodiments, a voice alarm may be provided when a user opens the oven door (or in response to some other trigger). In one or more embodiments, the warning may include a voice alarm initiated or triggered by the end of a cooking cycle.

Here, the indication color of the predetermined warning labels visually displayed through the display panel 142 may change depending on the level of the detected temperature. For example, the colors may change in the order of yellow, orange, and red, from the time at which the detected temperature starts exceeding the warning and/or reference temperature. For example, when the temperature is ≤100° F. or 40° C., the color may be yellow (e.g., as an indication of the door temperature); when the temperature is between 100° F./40° C. and 140° F./60° C., the color may be orange (e.g., as a warning of the door temperature); and when the temperature is ≥140° F./60° C., the color may be red (e.g., as a strong warning of the door temperature). Variants of the transition temperature between different colors may vary by local practice and/or user preferences (e.g., the temperature at which the warning changes from yellow to orange may be 120° F./50° C. the temperature at which the warning changes from orange to red may be 160° F./70° C. or 130° F./55° C.

etc.). The buzzer and/or sound generated by the buzzer 144 may change in such a manner that the interval of the buzzer and/or sound may become shorter as the detected temperature (i.e., level of the detected temperature) becomes higher relative to a certain temperature, and the interval of the buzzer and/or sound may become longer as the detected temperature (e.g., the level of the detected temperature) becomes lower relative to the certain temperature.

Accordingly, the user of the cooking device may recognize that the door (or door handle) has reached the temperature at which the user may suffer a burn through the audio-visual burn danger warnings outputted by the display panel and the buzzer, and thus the user can avoid a possible burn at the door (or door handle) of the cooking device.

Figure 3:
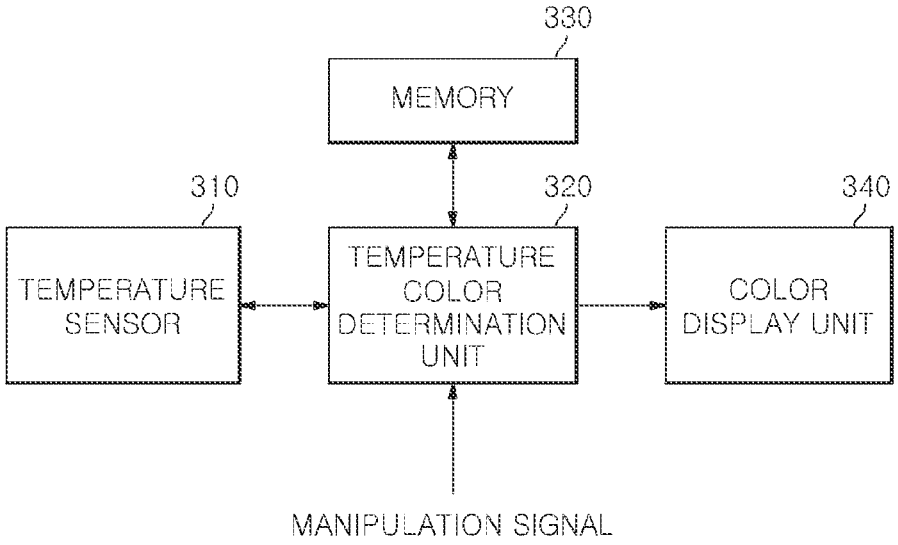
FIG. 3 is a block diagram of an apparatus for controlling a cooking device according to one or more other embodiment of the present disclosure.

FIG. 3 is a block diagram of an apparatus for controlling a cooking device according to one or more other embodiments of the present disclosure. The apparatus for controlling a cooking device may include a temperature sensor 310, a temperature color determination unit 320, a memory 330, and a color display unit 340.

Referring to FIG. 3, the temperature sensor 310 performs substantially the same functions as those of the temperature sensor 110 of FIG. 1, and, therefore a detailed description thereof is omitted in order to simplify the specification and avoid unnecessary and redundant descriptions.

The temperature color determination unit 320 may include a microprocessor for generally controlling (or executing) a cooking operation in a cooking device in response to a user manipulation and/or signal received through an input device or interface (not shown) (e.g., a touch panel, a manipulation panel, a manipulation switch, etc.). The temperature color determination unit 320 may determine the level of the temperature detected by the temperature sensor 310 when the cooking device executes a cooking mode, determine one of a plurality of predetermined temperature indications and/or colors to be displayed by comparing the determined level of the detected temperature with predetermined ranges of the reference temperature (e.g., a room temperature range, a pre-heat temperature range, or a burn danger warning temperature range) stored in the memory 330, generate a control instruction for selectively displaying the determined temperature indication and/or color, and provide the color display unit 340 with the control instruction.

To this end, the memory 330 stores data regarding the room temperature range, the pre-heat temperature range, and the burn danger warning temperature range and may also store information for the predetermined temperature indication colors. The plurality of predetermined temperature indication colors may include, for example, indication colors for room temperature (e.g., green color), pre-heat temperature (e.g., orange color), and burn danger warning temperature (e.g., red color).

Furthermore, the color display unit 340 may be a display panel on a part or the entirety of the glass surface 506 or 606 of the door 502 or 602 on the cooking device 500 or 600 as shown in, for example, FIGS. 5 and 6. The color display unit 340 visually informs a user of a current door temperature of the cooking device that is in a cooking mode by displaying a determined temperature indication and/or color (e.g., flickering a temperature indication and/or color, i.e., green, orange or red, on the entire surface of the display panel) when a control instruction for displaying the determined temperature indication and/or color is received from the temperature color determination unit 320. Here, the temperature indication and/or color, together with an explanation describing the meaning of the temperature indication and/or color, may be displayed through the display panel.

A series of processes for adaptively displaying temperature indications and/or colors depending on a temperature state of or at the door according to one or more exemplary embodiments of an apparatus for controlling a cooking device are described in detail below.

Figure 4:
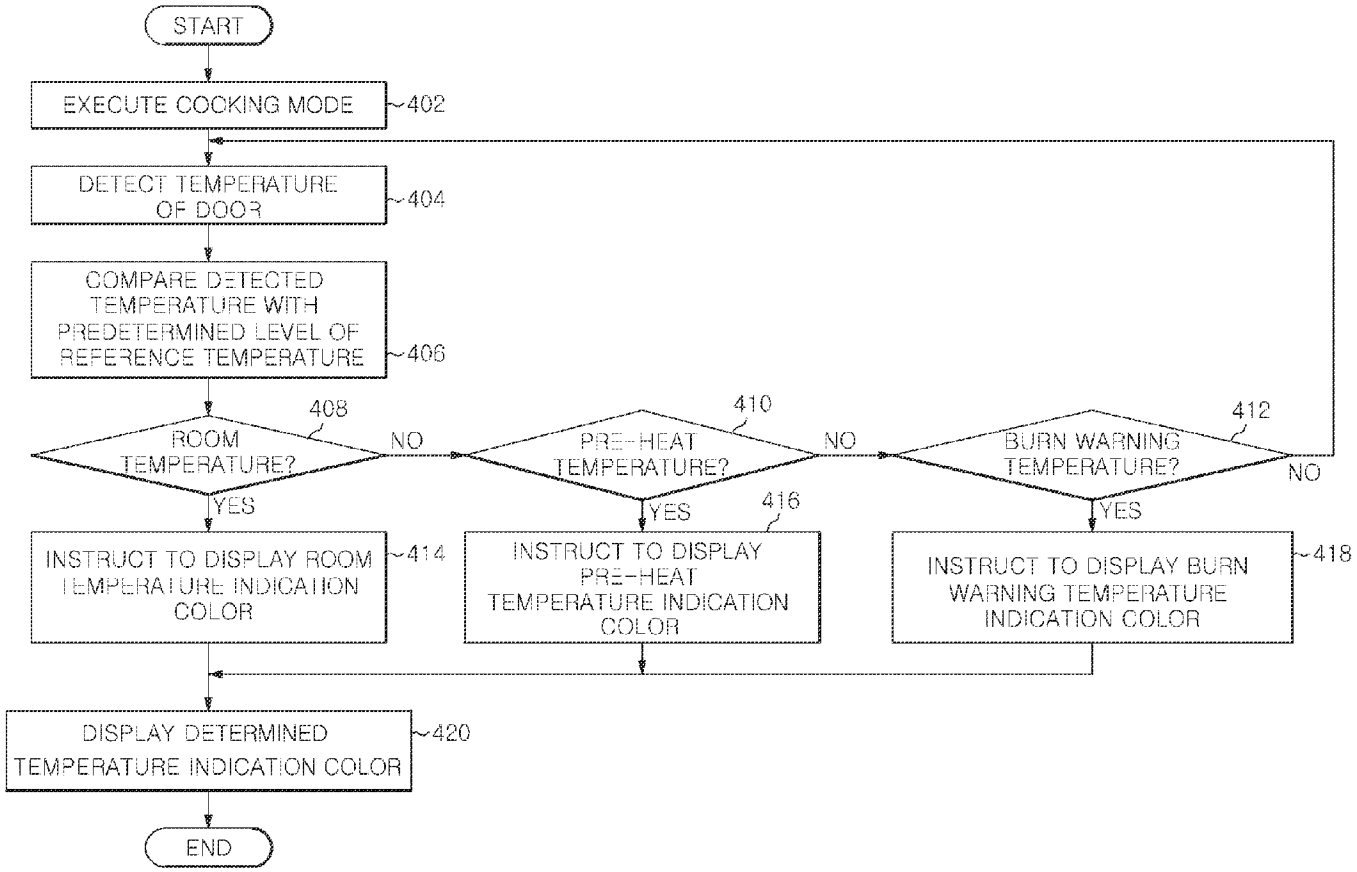
FIG. 4 is a flowchart illustrating a method for adaptively displaying a temperature indication color depending on a temperature state of the door of a cooking device according to one or more other embodiments of the present disclosure.

FIG. 4 is a flowchart illustrating a process for adaptively displaying temperature indications and/or color depending on a temperature state of or at the door of a cooking device according to one or more other embodiments of the present disclosure.

Referring to FIG. 4, when a cooking device executes a cooking mode according to a user's manipulation at 402, the temperature sensor 310 periodically samples and/or detects the temperature of or at the door (or door handle) in a predetermined cycle and provides the temperature color determination unit 320 with the detected temperature at 404.

The temperature color determination unit 320 determines the level of the detected temperature received from the temperature sensor 310 and determines whether the detected temperature corresponds to the room temperature range at 408, the pre-heat temperature range at 410, or the burn danger warning temperature range at 412 by comparing the determined level of the temperature with the predetermined reference temperature ranges (e.g., room temperature range, pre-heat temperature range, or burn danger warning temperature range) stored in the memory 330 at 406.

If, as the result of the determination at 408, the detected temperature is determined to correspond to the room temperature range, the temperature color determination unit 320 determines the room temperature indication and/or color, of the plurality of the predetermined temperature indications and/or colors, to be displayed, generates a control instruction for selectively displaying the determined room temperature indication and/or color, and provides the color display unit 340 with the control instruction at 414.

In response thereto, the color display unit 340 visually displays (or flickers) the room temperature indication and/or color (e.g., green color) through the display panel at step 420. Accordingly, the user of the cooking device can visually recognize that the temperature state of or at the door is the room temperature state. Here, the room temperature color may be displayed together with a guide explaining that the temperature state of or at the door is the room temperature state.

If, as the result of the determination at 410, the detected temperature is determined to correspond to the pre-heat temperature range, the temperature color determination unit 320 determines the pre-heat temperature indication and/or color, of the plurality of predetermined temperature indications and/or colors, to be displayed, generates a control instruction for selectively displaying the determined pre-heat temperature indication and/or color, and provides the color display unit 340 with the control instruction at 416.

In response thereto, the color display unit 340 visually displays (or flickers) the pre-heat temperature indication and/or color (e.g., yellow color) through the display panel at 420. Accordingly, the user of the cooking device can visually recognize that the temperature state of the door is a pre-heat temperature state. Here, the pre-heat temperature color may be displayed together with a guide explaining that the temperature state of the door is a pre-heat temperature state.

If, as the result of the determination at 412, the detected temperature is determined to correspond to the burn danger warning temperature range, the temperature color determination unit 320 determines the burn danger warning temperature indication and/or color, of the plurality of predetermined temperature indication colors, to be displayed, generates a control instruction for selectively displaying the determined burn danger warning temperature indication and/or color, and provides the color display unit 340 with the control instruction at 418.

In response thereto, the color display unit 340 visually displays (or flickers) the burn danger warning temperature indication and/or color (e.g., red color) through the display panel at 420. Accordingly, the user of the cooking device can visually recognize that the temperature state of the door is the burn danger state. Here, the burn warning temperature color may be displayed together with a guide explaining that the temperature state of the door is the burn danger state.

Meanwhile, in one or more embodiments, a specific color may be outputted (or displayed) through the display panel depending on the temperature state of the door, but the present disclosure is not necessarily limited thereto. For example, a specific color corresponding to a temperature state of the door may be outputted (or displayed) without flickering.

Although exemplary embodiments of the present disclosure are described above with reference to the accompanying drawings, those skilled in the art will understand that the present disclosure may be implemented in various ways without changing the necessary features or the spirit of the present disclosure.

Therefore, it should be understood that the exemplary embodiments described above are not limiting, but only an example in all respects. The scope of the present disclosure is expressed by claims below, not the detailed description, and it should be construed that all changes and modifications achieved from the meanings and scope of claims and equivalent concepts are included in the scope of the present disclosure.

From the foregoing, it will be appreciated that various embodiments of the present disclosure have been described herein for purposes of illustration, and that various modifications may be made without departing from the scope and spirit of the present disclosure. The exemplary embodiments disclosed in the specification of the present disclosure do not limit the present disclosure. The scope of the present disclosure will be interpreted by the claims below, and it will be construed that all techniques within the scope equivalent thereto belong to the scope of the present disclosure.

What is claimed is:

1. A method for controlling a cooking device, comprising:

detecting a temperature of a door on the cooking device;

comparing the detected temperature with a predetermined warning and/or reference temperature;

generating a predetermined warning if the detected temperature is equal to or higher than the predetermined warning and/or reference temperature; and outputting or displaying the predetermined warning, wherein outputting the predetermined warning comprises flickering one or more warning labels corresponding to the predetermined warning on a display panel on the cooking device, wherein the one or more warning labels have a color that changes depending on a level of the detected temperature, wherein outputting the predetermined warning comprises generating an intermittent buzzer and/or sound with a buzzer on the cooking device, wherein the buzzer and/or sound has an interval that becomes shorter as the detected temperature becomes higher, wherein the warning and/or reference temperature is changeable by a user of the cooking device.

2. The method of claim 1, wherein outputting the predetermined warning comprises flickering an indication lamp on the cooking device.

3. An apparatus for controlling a cooking device, the apparatus comprising:

a temperature sensor configured to detect a temperature of a door on the cooking device;

a warning control unit configured to compare the detected temperature with a predetermined warning and/or reference temperature and generate a predetermined warning if the detected temperature is equal to or higher than the predetermined warning and/or reference temperature; and a warning display unit configured to output the predetermined warning, wherein the warning display unit comprises a display panel configured to flicker one or more warning labels corresponding to the predetermined warning, wherein the warning display unit displays an indication color that depends on a level of the detected temperature, wherein the warning display unit comprises a buzzer that outputs an intermittent buzzer and/or sound corresponding to the predetermined warning, wherein an interval of the buzzer and/or sound becomes shorter as the detected temperature becomes higher, wherein the warning and/or reference temperature is changeable by a user of the cooking device.

4. The apparatus of claim 3, wherein the temperature sensor is on an inner side of an outside glass of the door having a dual glass structure.

5. The apparatus of claim 3, wherein the display panel comprises a part or an entirety of a front surface of the door.

6. The apparatus of claim 3, wherein the warning display unit comprises an indication lamp that flickers in response to an instruction received from the warning control unit.

* * * * *